US007806090B2

(12) United States Patent
McBurney, Sr. et al.

(10) Patent No.: US 7,806,090 B2
(45) Date of Patent: Oct. 5, 2010

(54) BOILER APPARATUS FOR COMBUSTING PROCESSED AGRICULTURE RESIDUES (PAR) AND METHOD

(76) Inventors: John Curtis McBurney, Sr., 10815 Avian Dr., Alpharetta, GA (US) 30022; Henry Christopher Balance, 914 Collier Rd., Apt. 1304, Atlanta, GA (US) 30318; Raymond C. Ganga, 5272 Oxbow Rd., Stone Mountain, GA (US) 30087

( * ) Notice: Subject to any disclaimer, the term of this patent is extended or adjusted under 35 U.S.C. 154(b) by 428 days.

(21) Appl. No.: 12/020,907

(22) Filed: Jan. 28, 2008

(65) Prior Publication Data

US 2009/0188448 A1 Jul. 30, 2009

(51) Int. Cl.
*F22B 33/00* (2006.01)

(52) U.S. Cl. ..... 122/7 R; 60/645; 110/342; 110/347

(58) Field of Classification Search ..... 122/7 R, 122/4 D, 6 A; 60/39.182, 645; 432/16, 21, 432/27, 58; 110/341, 342, 343, 346, 347
See application file for complete search history.

(56) References Cited

U.S. PATENT DOCUMENTS

| | | | | |
|---|---|---|---|---|
| 4,509,326 | A * | 4/1985 | Jorgensen | 60/39.182 |
| 5,165,903 | A * | 11/1992 | Hunt et al. | 423/239.1 |
| 5,189,964 | A * | 3/1993 | Rich, Jr. | 110/347 |
| 5,406,914 | A * | 4/1995 | Hyppanen | 122/4 D |
| 5,501,160 | A * | 3/1996 | Goldman et al. | 110/229 |
| 5,590,610 | A | 1/1997 | Sanbonmatsu | |
| 6,615,751 | B1 | 9/2003 | Sorensen et al. | |
| 7,007,616 | B2 * | 3/2006 | Abrams et al. | 110/342 |
| 2004/0134395 | A1 | 7/2004 | Eberhardt et al. | |
| 2007/0020375 | A1 | 1/2007 | Jansen et al. | |
| 2009/0031934 | A1 * | 2/2009 | Ganga et al. | 110/346 |

FOREIGN PATENT DOCUMENTS

| | | | |
|---|---|---|---|
| EP | 1434003 | A | 6/2004 |
| FR | 2761458 | A | 10/1998 |
| FR | 2795161 | A | 12/2000 |
| JP | 14-155287 | A | 5/2002 |

(Continued)

OTHER PUBLICATIONS

International Search Report, PCT/US2009/030188, Aug. 18, 2009.

(Continued)

*Primary Examiner*—Gregory A Wilson
(74) *Attorney, Agent, or Firm*—Baker Donelson Bearman Caldwell & Berkowitz, PC

(57) ABSTRACT

An apparatus that extracts energy from processed agriculture residue (PAR) such as dried distiller grains or rapeseed as a biomass fuel having about 12% by weight or less moisture combusted in a vertically elongated combustion chamber having at least one suspension burner that projects a flame down a longitudinal axis of combustion chamber for transferring heat to heat collection surface located radially from the flame, an exhaust opening vertically spaced from a distal end of the flame containment portion and vertically spaced lower of a substantial majority of the heat collection surface, and a temperature modulator that supplies a cooling air. A method of extracting energy from PAR fuel is disclosed.

33 Claims, 8 Drawing Sheets

FOREIGN PATENT DOCUMENTS

| | | | |
|---|---|---|---|
| JP | 16-205161 | A | 7/2004 |
| JP | 18-132811 | A | 5/2006 |
| WO | 9844297 | | 10/1998 |

OTHER PUBLICATIONS

Written Opinion of International Search Authority, PCT/US2009/030188, Aug. 18, 2009.

McBurney Project File; "Large Scale Wood Waste Fired Power Generating Plant"; The McBurney Corporation, P.O. Box 1827, Norcross, GA 30091 (Mar. 1998).

McBurney Project File; "Wood Fired Steam Plant Provides Thermal Energy for Specialty Basket Manufacturer"; The McBurney Corporation, P.O. Box 1827, Norcross, GA 30091 (Mar. 1998).

McBurney Project File; "Wood Fired Steam Plant Provides Thermal Energy for Romanian Sawmill"; The McBurney Corporation, P.O. Box 1827, Norcross, GA 30091 (Mar. 1998).

Engineering Services; McBurney brochure; The McBurney Corporation, P.O. Box 1827, Norcross, GA 30091 (prior to Aug. 3, 2007).

Construction Services; McBurney brochure; The McBurney Corporation, P.O. Box 1827, Norcross, GA 30091 (prior to Aug. 3, 2007).

Maintenance & Repair; McBurney brochure; The McBurney Corporation, P.O. Box 1827, Norcross, GA 30091 (prior to Aug. 3, 2007).

McBurney Field Services; McBurney brochure; The McBurney Corporation, P.O. Box 1827, Norcross, GA 30091 (prior to Aug. 3, 2007).

McBurney Energy Systems; Modul-Pak II Boiler; McBurney brochure; The McBurney Corporation, P.O. Box 1827, Norcross, GA 30091 (for purposes of citation, prior to Aug. 3, 2007).

Modul-Pak brochure; Industrial Boiler, Co, Inc., PO Drawer 2258, Thomasville, GA 31799 (for purposes of citation, prior to Aug. 3, 2007).

Larsen et al., "Relations Between Combustion, Deposition, Flue Gas Temperatures and Corrosion in Straw-Fired Boilers," 2nd World Conference on Biomass for Energy, Industry and Climate Protection, Rome, Italy (May 10-14, 2004).

* cited by examiner

BOILER APPARATUS FOR COMBUSTING PROCESSED AGRICULTURE RESIDUES (PAR) AND METHOD

TECHNICAL FIELD

The present invention relates to boilers for combusting byproducts from industrial processes. More particularly, the present invention relates to a field-erected furnace and boiler for combusting processed agriculture residues (PAR) materials and method.

BACKGROUND OF THE INVENTION

There are a variety of fuel sources from which energy can be extracted for useful work such as generation of steam, heat, and generation of electricity. Fuel sources generally are cost components that incur expenses for procurement, processing for use as a fuel, transport, storage, and use. Such fuels include coal, natural gas, and the like.

Alternative fuel sources include energy-containing combustible products such as members of the plant kingdom which have been processed, for example, fibers from agricultural processing. Fibrous byproducts often result from agricultural product processing systems. The term "byproduct" is used to refer to a secondary or incidential product arising from a manufacturing process of agricultural products, for example processed agriculture residues (PAR) including distiller grains and rapeseed. Such byproduct may have some economic value or in a worst case, no economic value and therefore is a waste. For example, ethanol production using distiller grains generate as a byproduct fibrous materials that are substantially depleted of carbohydrates. Rapeseed processing generates an oil suitable for biodiesel suitable for powering motor vehicles but also produces crushed rapeseed as a byproduct. Use of fiber byproduct for extraction of energy provides an economic benefit from a material that otherwise may have disposal costs and no or limited other practical benefit. Fiber is used herein to refer to any material derived from a member of the plant kingdom that has been physically separated or at least partially depleted (i.e., to less than about 40% d.s.b. total) of sugars, starch, protein, and germ. Fiber can be burned or combusted to provide energy; depending on the plant source, the fiber's composition, and its water content, it typically has a higher heating value (HHV) of about 7000-10,000 BTU/lb (dry basis). Other plant materials, such as corn germ, can have HHVs as high as 15,000 BTU/lb (dry basis). Therefore, theoretically, fiber or other plant material could be burned in order to wholly or partially power industrial processes.

Fibers however have generally not been used as an energy source. Most fiber contains relatively high levels of ash (inorganic ions, such as elemental or compounds of phosphorous, calcium, magnesium, sodium, and potassium). For example, typical corn kernel fiber contains about 4 percent dried solid basis (DSB) ash, of which phosphorous is the most common element (total ash containing about 40 WT % $P_2O_5$). Distiller grains contain about 5 percent DSB ash, with total ash similarly containing about 40 WT % $P_2O_5$ Fiber ash generally has a relatively low fusion or melting point, meaning that at high temperatures the ash is molten, and will form slag on refractory or metallic surfaces of a furnace, boiler or flue gas stack if the molten ash contacts these surfaces. Ash at temperatures below its melting point is generally in the form of small, generally irregularly shaped, solid particles.

One byproduct of bioethanol processing using corn or other grains is distiller grains (DG). The DG byproduct generally comes from the process as wet cake at about a 70% moisture content. Heretofore DG products have been used as a blending material for cattle feed, and thus derive some economic value from the byproduct. Such use of this byproduct however has additional costs. The moisture content of the DG must be reduced from about 70% to about 10% after which the material is customarily referred to as dried distiller grains (DDG). It is impractical to dry this material naturally; accordingly, the drying of this byproduct to be a useable feed blended material incurs additional fuel and processing costs.

As an alternative to a cattle feed blend, the energy contained in the DDG could be extracted through combustion. Fluidized bed combustion chambers however are impractical for combusting this byproduct as a fuel. The temperature of the fluidized bed would have to be carefully monitored in order to make adjustments in temperature in the event that the DDG ash-agglomerates in the fluid bed and forms a slag coating on the bed material. Slag coatings create the potential for a "frozen bed" or at least the formation of large agglomerated masses ("clinkers") within the bed. This slag coating detracts from the heat extraction, reduces the efficiency of the combustion, and after significant buildup, prevents the fluidized bed combustor from working properly. Clearing a frozen bed or removing large agglomerations of material is time consuming and difficult work that involves cessation of the combustion chamber operation.

In addition, the relatively high moisture content of the DG prevents the DG from being stored for subsequent usage. The moisture causes the DG to ferment in storage, and yet potentially may cause a fire in the storage chamber.

DDG (having a moisture content of 12% weight or less) however is readily storable. Periodic cessation of combustion processes, such as for example, during cleaning of a combustion chamber that combusts DDG, would not create a storage problem, because additional DDG received from the ethanol distilling processing can be placed in storage silos for subsequent use.

There are drawbacks however to the use of DDG as a combustion fuel. Because this byproduct has a high fouling potential, it is believed that conventional furnace combustion chambers are unsatisfactory for achieving a low furnace exit gas temperature to preclude slag formation. The high fouling potential is due in part to constituents in the ash that have low melt temperatures relative to the operating temperature range of boilers. Also, high fuel-bound nitrogen can increase nitrogen oxide (NOx) emissions.

Similarly, cake from crushing rapeseed for oil production has similar moisture and ash content problems, and has similar elemental analysis for potential use as a fuel.

Accordingly, there is a need in the industry for extracting energy from processed agriculture residues (PAR). It is to such that the present invention is directed.

SUMMARY OF THE INVENTION

The present invention meets the need in the art for an apparatus and method for extracting energy from processed agriculture residue (PAR) products. The apparatus comprises a vertically elongated combustion chamber having a top end, a flame containment portion, and a lower end portion. A supply of a PAR fuel for combusting in the combustion chamber has a moisture content of about 12% by weight or less. At least one suspension burner mounted at the top end of the combustion chamber mixes air with the supply of the PAR fuel and initiates combustion of the mixture. The burner is configured for projecting a flame down a longitudinal axis of the flame containment portion of the combustion chamber. A wall of the combustion chamber defines a heat transfer apparatus having at least a portion of a heat collection surface located radially from the flame. An exhaust opening in a hopper wall of the combustion chamber is vertically spaced from a distal end of the flame containment portion and vertically spaced lower than a substantial majority of the heat collection surface. The PAR fuel combusted within the combustion chamber yields a mixture containing hot flue gas of a first temperature and entrained ash (a portion of which may not be molten) above the exhaust opening, the first temperature at about a combustion temperature of the flame, with heat from the hot flue gas transferring to the heat collection surface substantially by radiation to yield a mixture of warm flue gas of a second temperature and non-molten ash, the second temperature in a range from about an ash fusion temperature to about a molten ash temperature, the range lower than the combustion temperature. A temperature modulator controls a supply of a cooling gas at a third temperature, which modulator meters the cooling gas into the combustion chamber near the exhaust opening, to cool the warm flue gas and yield a mixture containing cool flue gas at a fourth temperature and non-molten ash, the fourth temperature lower than the second temperature in a range from about a temperature suitable for use in downstream heat exchange processes to about less than a lowest melting temperature of any ash constituent, which cool flue gas exits from the combustion chamber through the exhaust opening.

In another aspect, the present invention provides a method for extracting energy from a processed agriculture residue (PAR) fuel, comprising the steps of:

(a) introducing a PAR fuel through at least one burner attached to a top end of a vertically elongated combustion chamber, the burner configured for projecting a flame down a longitudinal axis of a flame containment portion of the combustion chamber;

(b) combusting the PAR fuel within a flame in the flame containment portion of the combustion chamber to yield a mixture containing hot flue gas and entrained partially molten ash;

(c) transferring heat from the hot flue gas to a heat transfer apparatus having at least a portion of a heat collection surface located radially from the flame in the flame containment portion of the combustion chamber substantially by radiation prior to any substantial contact of molten ash to a surface of the combustion chamber to yield a mixture of warm flue gas and non-molten ash, the warm flue gas at a second temperature in a range from about an ash fusion temperature to about a molten ash temperature, the second temperature lower than the combustion temperature;

(d) inserting into the combustion chamber a cooling gas near an exhaust opening in a hopper wall of the combustion chamber vertically spaced from a distal end of the flame containment portion and vertically spaced lower tan a substantial majority of the heat collection surface, the cooling gas at a third temperature to cool the warm flue gas and yield a mixture containing cool flue gas and non-molten ash, the cool flue gas at a fourth temperature lower than the second temperature and the third temperature lower than the fourth temperature, the fourth temperature in a range from about a temperature suitable for use in downstream heat exchange processes to about less than a lowest melting temperature of any ash constituent; and (e) removing the cool flue gas from the combustion chamber through the exhaust opening.

Objects, advantages, and features of the present invention will become readily apparent upon reading the following detailed description in conjunction with the drawings and the appended claims.

DETAILED DESCRIPTION

Figure 1A:
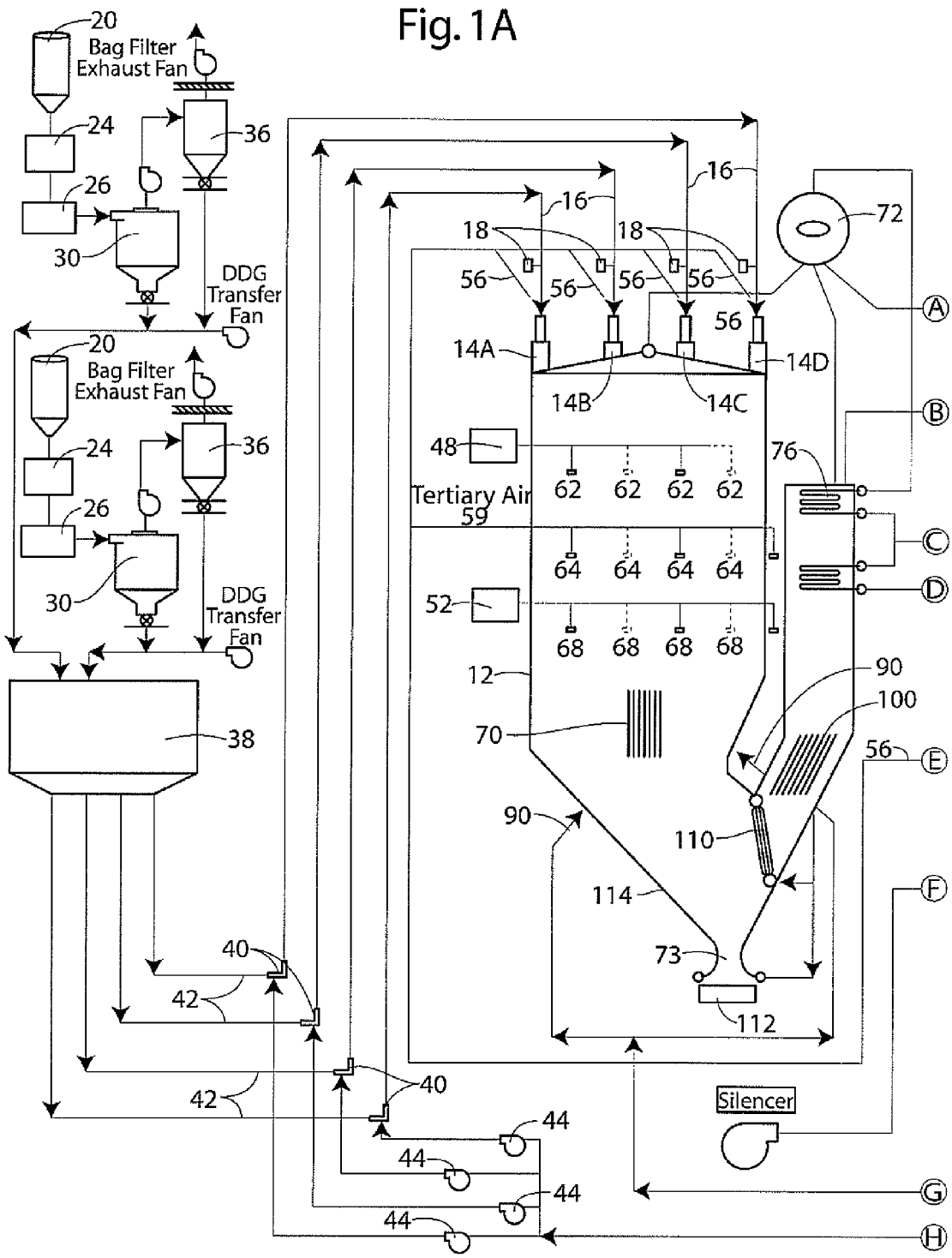
FIGS. 1A and 1B are a schematic illustration of an energy recovery apparatus for combusting processed agriculture residue fuel to extract energy according to the present invention.
Figure 1B:
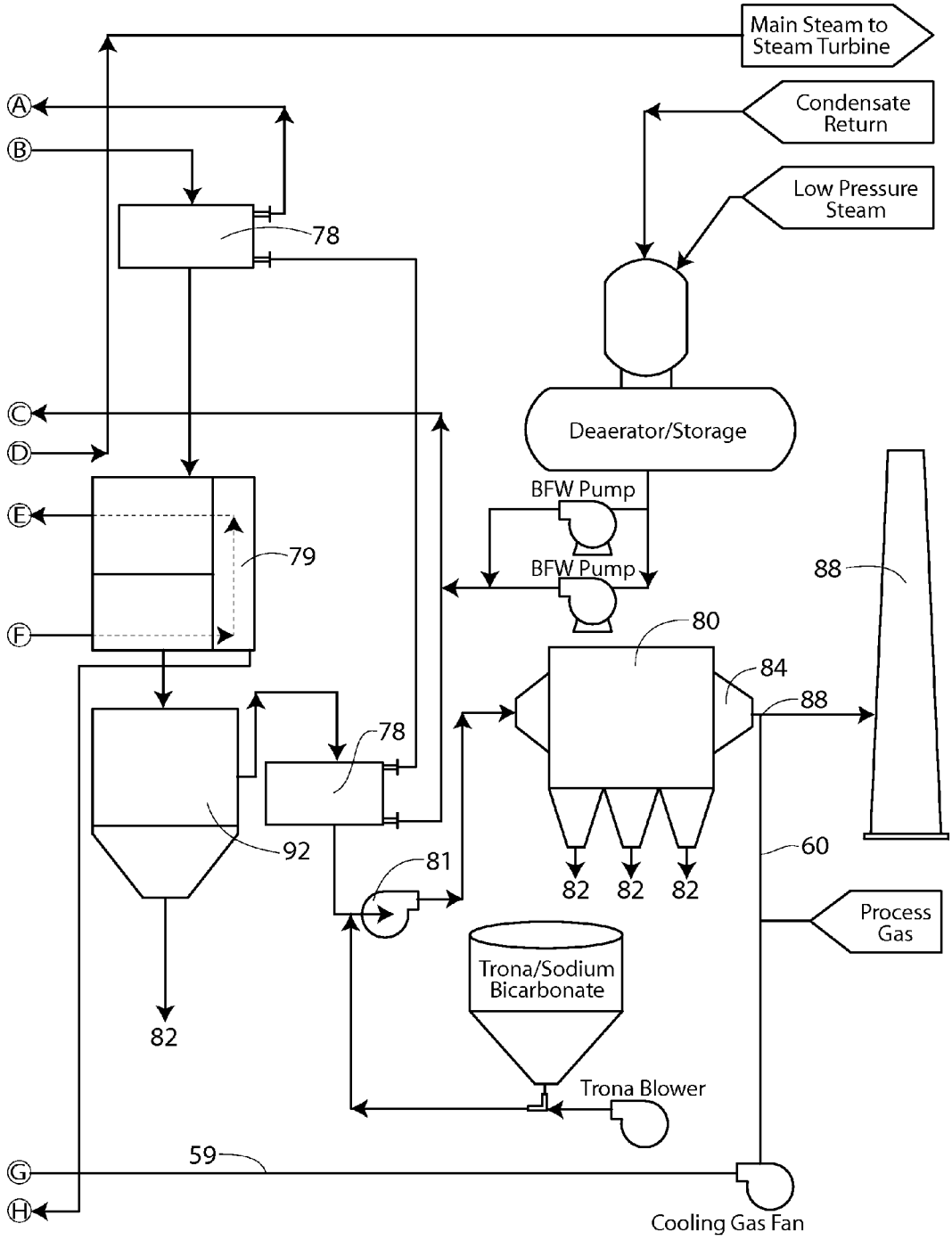

With reference to the drawings, in which like parts have like reference numerals, FIGS. 1A and 1B illustrate a schematic view of an energy recovery system 10 with a combustion chamber or boiler 12 for combusting processed agriculture residue (PAR) fuel to extract energy in accordance with the present invention. The boiler 12 is a down flow-type having at least one burner 14 mounted at a top end that mixes air from an inlet 18 with a supply 16 of a PAR fuel used for combustion. In the illustrated embodiment, the boiler 12 includes four (4) separate spaced-apart burners 14*a*, 14*b*, 14*c* and 14*d*. The following discussion refers to one burner 14 but applies to each of the burners 14*a*, 14*b*, 14*c* and 14*d*.

In the illustrated embodiment, a plurality of silos 20 contain a replenishable supply of PAR such as dried distiller grains (DDG) that is a byproduct of distilling processes. The PAR fuel passes 22 from the silos 20 through a stone separator/plate magnet 24 and into a grinder 26. The grinder 26 operates to provide a fine particle size distribution. The grinder 26 connects 28 to a cyclone separator 30 that connects 32 with a bag filter 36. Air from the cyclone separator 30 passes through the filter 36 to an exhaust so that the filter collects separated dust. A metering bin 38 receives dry, fine granular PAR fuel from the cyclone separator 30. The metering bin 38 includes conventional metering screws that meter the fuel for use at the burner. It is to be appreciated that a separate metering bin 38 may provide fuel to the respective separate burners 14*a*, 14*b*, 14*c* and 14*d*, although one metering bin is satisfactory for supply to all of the burners with a pair of metering screws dedicated to a respective burner.

A venturi fuel feed device 40 connects 42 to the metering bin 38. The venturi fuel feed device 40 mixes with a primary air source 44 of high pressure air. The high pressure air passes through the venturi fuel feed device 40 and carries fuel from an outlet of the metering screws of the metering bin 38 through the burner 14 and into a flame portion of the boiler 12.

A supply 48 of a combustion additive is blended into the boiler 12 for controlling the character of the slag or build-up of molten ash on surfaces of the boiler 12. Slag is a common byproduct of combustion that solidifies and negatively impacts the heat transfer in the boiler 12, as well as necessitating downtime for removal. In an alternate embodiment, the burner 14 includes a pilot (not illustrated). The pilot facilitates ignition of the flame using the PAR fuel. A reagent storage vessel 52 provides a supply of a reagent that is selectively injected into the boiler 12 for a purpose discussed below. In the illustrated embodiment using DDG fuel, the reagent is urea or ammonia. The reagent is injected into the boiler 12 through nozzles 68.

A secondary airflow inlet 56 receives combustion air from a second supply 58 of combustion air for inserting into the combustion chamber. The secondary airflow inlet 56 includes a damper for modulating the flow of the secondary air into the flame contained within the boiler 12. A tertiary air inlet 59 supplies air for input to a lower portion of the boiler 12. The flue gas recirculation piping 60 supplies cooling gas as discussed below. In one embodiment, an inlet 62 supplies a combustion additive for modifying the properties of ash generated by the combustion of PAR fuel, as discussed below. A sensor monitors NOx concentrations in the flue gas for metering the insertion of reagent.

The sidewalls of the boiler 12 are defined by a plurality of parallel water tubes 70 (see FIGS. 2 and 3) that connect at upper ends such as through headers with a steam drum 72. The steam drum 72 separates high quality steam from the boiler water, then supplies the steam to a superheater 76 if included in the energy recovery system 10, or the steam flows from the steam drum through an outlet and pipes to supply industrial processes that conventionally rely on steam. A hopper 73 in a lower end of the combustion chamber collects dust and ash particulates. A flue gas exit 74 conveys flue gas from the boiler 12 through a screen 110 and connection chamber 100 discussed below, to a superheater 76, an economizer 78, and an air heater 79, for conventional purposes. The flue gas passes to downstream processes for emission reduction treatment such as the electrostatic precipitator 80 and ash collection and storage 82. The flue gas exits the emission reduction treatment for heating or other processes requiring heated gas before a discharge 84 to final emissions control equipment including a stack 86. A fan 81 maintains an induced draft from the boiler through the superheater, the economizer, and the air heater. A mechanical dust collector 92 prior to the fan 81 removes larger particles in the flue gas.

A bypass 88 directs a portion of the flue gas through the flue gas recirculation duct 60 to the cooling gas inlets 90 of the boiler 12. A damper controls the flow of the flue gas back to the boiler 12 through the inlets 90.

The lower end of the boiler 12 includes an ash hopper 73 that discharges ash and particulate to a transport mechanism, such as a drag chain conveyer for delivering the ash to an ash pit and ash silo.

The PAR energy recovery system 10 according to the present invention includes field erected construction. The term "field erected" as used herein refers to the transport of components and equipment to a selected site for installation of the PAR energy recovery system, such as in proximity to a distillation processing facility such as ethanol production. An illustrated embodiment of the PAR energy recovery system uses boilers of 30 feet depth and width (center-line to center-line of the sidewall tubes, with a furnace height of 92 feet from a center line of lower sidewall headers to the roof tubes. Other sizes of boilers can be readily used. In the illustrated embodiment, the furnace is of membrane wall construction with wall tubes bent as required to accommodate access doors, burner openings, reagent nozzles, cooling gas inlets, tertiary air inlets, fuel additive injection, observation doors and sootblowers, as applicable. It is to be appreciated that the boiler may be resized, or that two or more such PAR energy recovery systems 10 may be linked together, depending on the volume of PAR byproduct to be combusted or the capacity of steam or heat output required for downstream manufacturing processes in a manufacturing facility.

Figure 2:
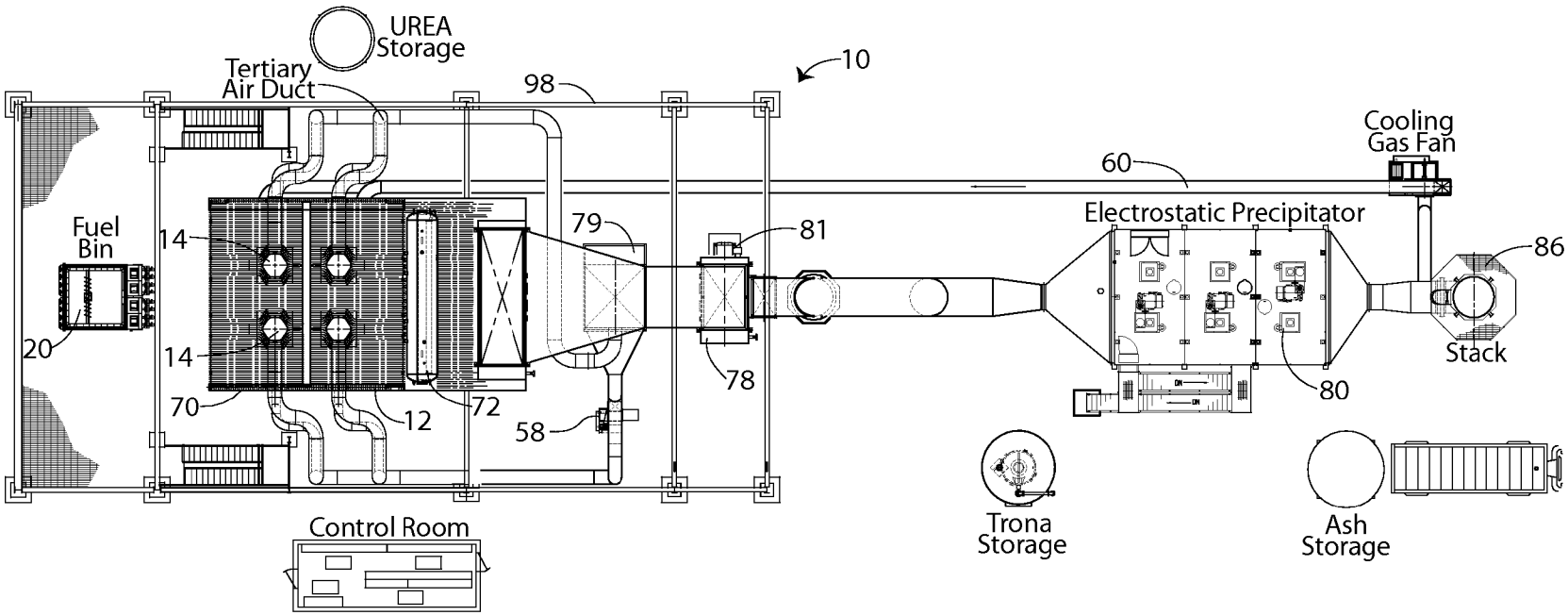
FIG. 2 illustrates in top plan view the processed agriculture residue energy recovery apparatus depicted in FIG. 1.
Figure 3:
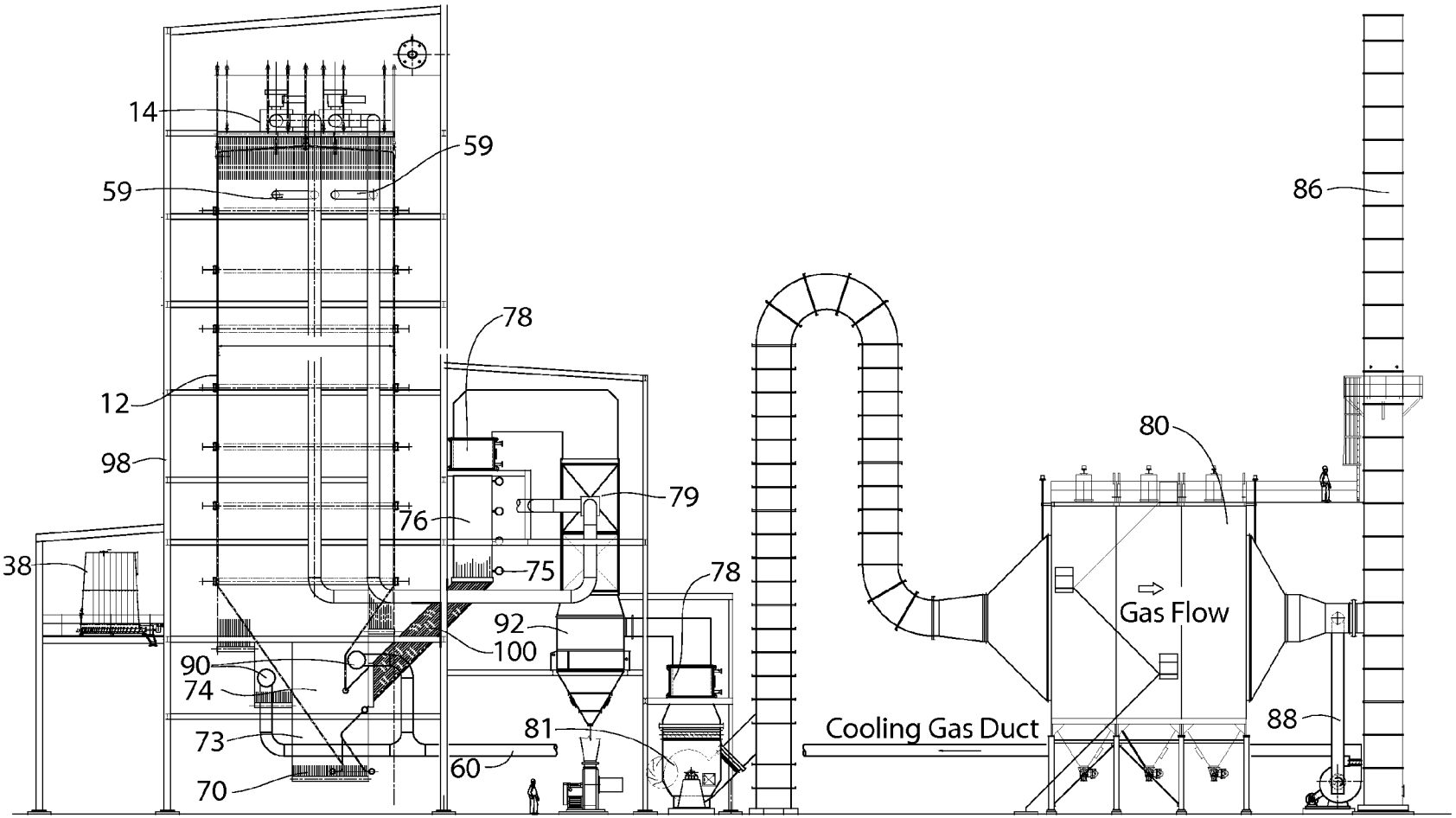
FIG. 3 illustrates in side elevation view the processed agriculture residue energy recovery apparatus depicted in FIG. 2.

FIGS. 2 and 3 are a top plan view and a side elevation view of the PAR energy recovery system 10 (not including the silos 20 and related fuel handling/processing equipment) depicted in FIG. 1. The boiler 12 is generally suspended vertically within a steel frame 98. The energy recovery system 10 provides a gas-tight envelope for extraction of thermal energy from PAR fuel material. The primary air supply 44 intermixes with the PAR fuel for carrying or conveying the fuel into the burner 14 through the inlet 18. The secondary air inlet 56 receives heated air from a supply 58. A forced draft fan impels the secondary air through the inlet 56 into the wind box of the burner 14 for shaping the flame of the burning PAR fuel in the flame portion of the boiler. The tertiary air 59 flows through a header having a plurality of nozzles 64 that direct air into the interior of the boiler 12. The secondary air stages the flame of the burning fuel and air within the combustion chamber. The flame of burning PAR includes entrained ash. The heat is given up to the walls of the boiler 12 formed of water tubes 70. The water tubes define a heat collection surface spaced apart from the flame. The tubes 70 transfer the heat to the water in the tubes. The heated water forms steam that rises upwardly into the steam drum 72 where the steam is collected and directed to downstream processes requiring steam.

The flue gas exits through the flue gas outlet 74. The flue gas outlet 74 is vertically spaced from a proximate end of the flame containment portion and vertically spaced lower than a substantial majority of the heat collection surface. The flue gas outlet 74 is located closely to the hopper portion of the boiler 12. The cool flue gas passes through the screen 110 and then to the screen exit 75. A portion of the flue gas flows through the bypass 88 to the boiler 12 through the cooling gas inlets 90. In an alternate embodiment, the bypass 88 receives flue gas after emissions reduction and collection downstream of the electrostatic precipitator (ESP) 80. The cooling gas quenches the flue gas in the lower portion of the boiler 12 to maintain the cool flue gas temperature approximately at a pre-selected temperature. In the illustrated embodiment, the temperature of the cool flue gas that passes through the flue gas outlet 74 is at a temperature of approximately 1250° F. The screen 110 is comprised of water tubes 70 which absorb heat from the cool flue gas to further reduce the temperature of the cool flue gas to a fifth temperature not to exceed 1100° F.

At the flue gas outlet 74, the heated gas within the boiler 12 changes directional flow from generally vertically downward to horizontal, and outwardly to the screen, the superheater, the economizer, the dust collector and the air heater. The entrained ash however is not molten due to mixing with the low temperature cooling gas in the lower portion of the boiler. The ash is not molten, but solid particulate. The mechanical dust collector 92 removes larger particulates from the flue gas stream. The ash is carried in the flue gas by the induced draft from the fan 81 to the electrostatic precipitator 80 where it is collected and stored for subsequent discharge to ash treatment or disposal, such as by truck.

Figure 5:
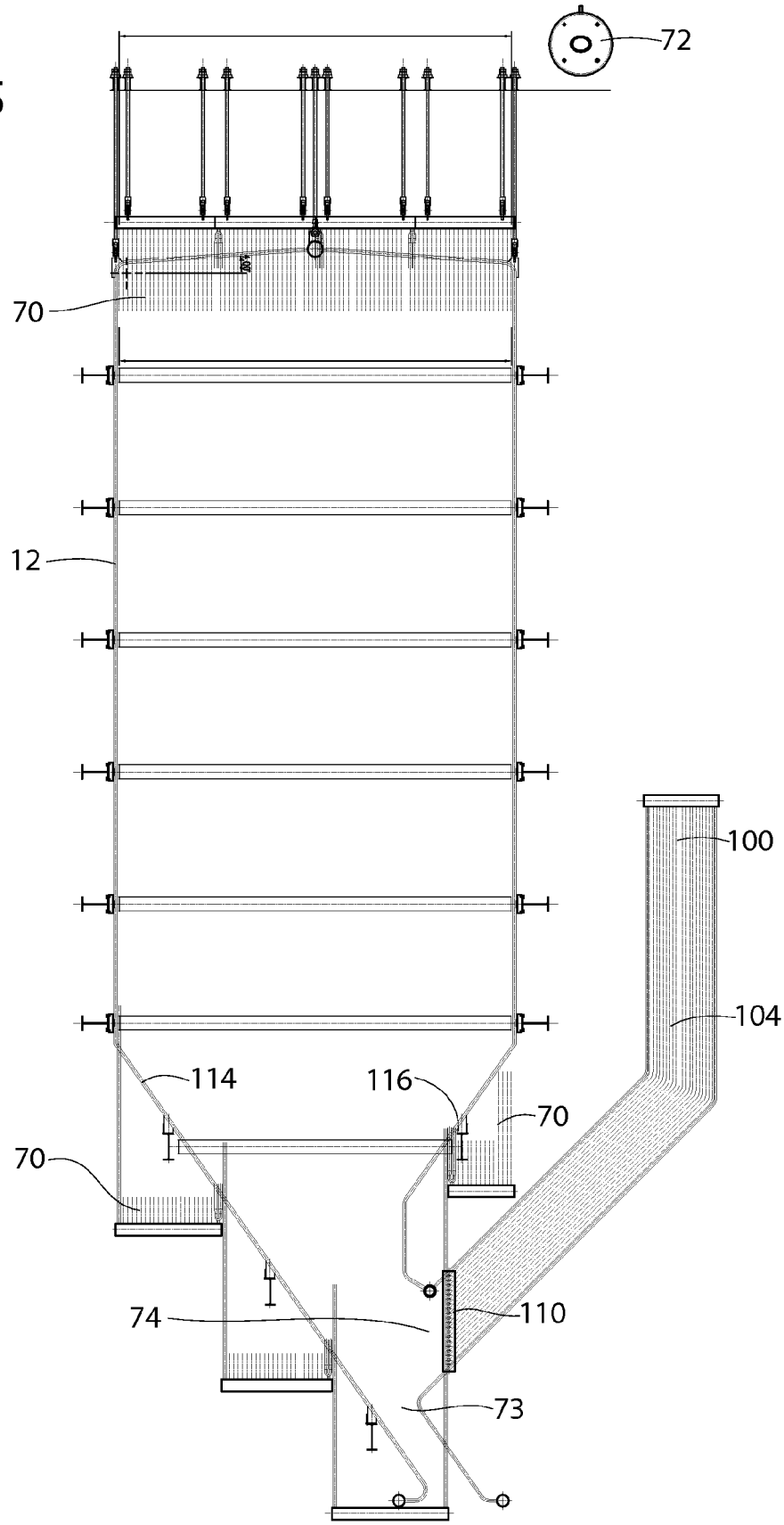
FIG. 5 illustrates in side elevation view the boiler of the processed agriculture residue energy recovery apparatus depicted in FIG. 1.
Figure 6:
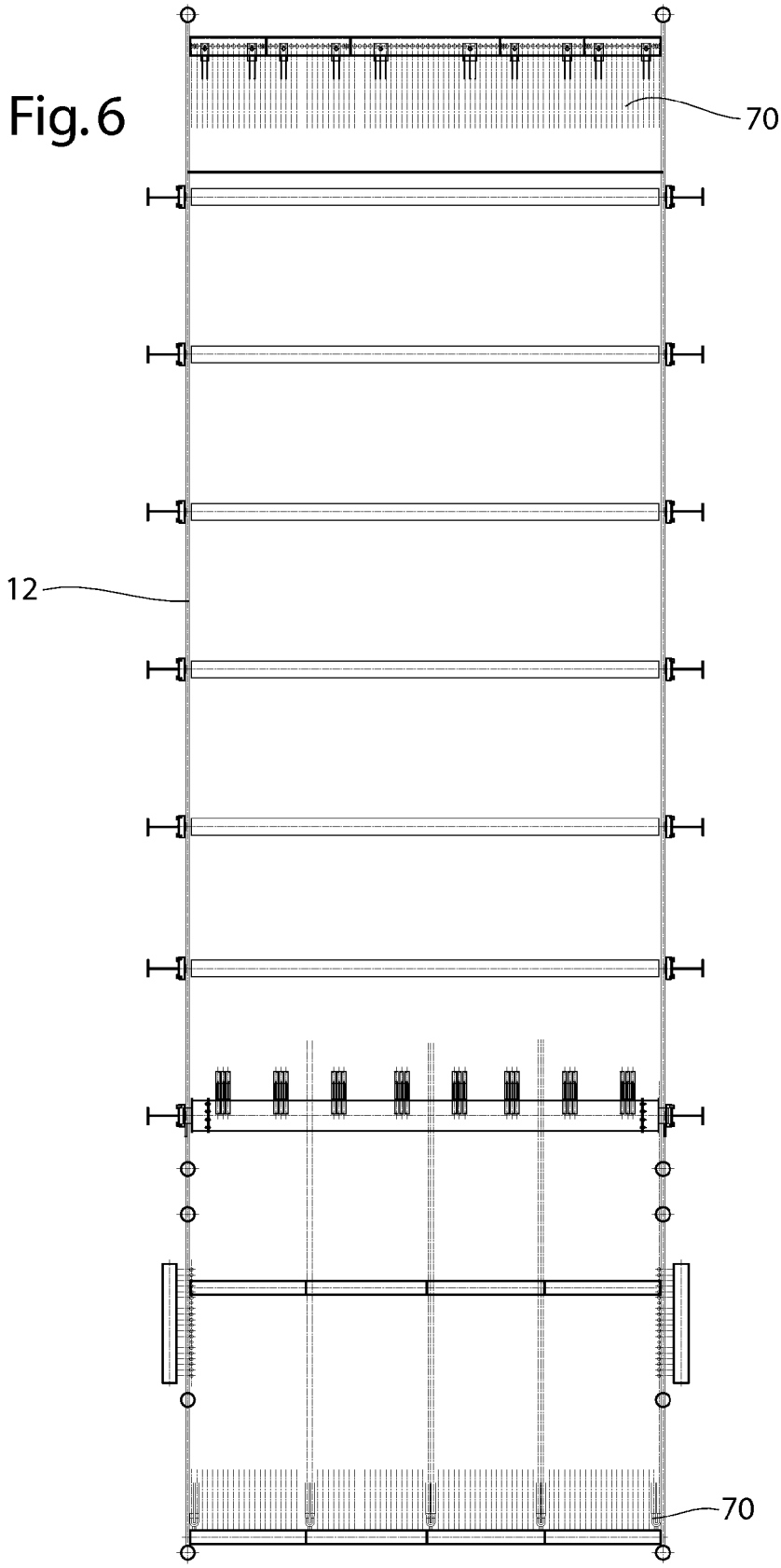
FIG. 6 illustrates in front elevation view the boiler of the processed agriculture residue energy recovery apparatus depicted in FIG. 5.
Figure 7:
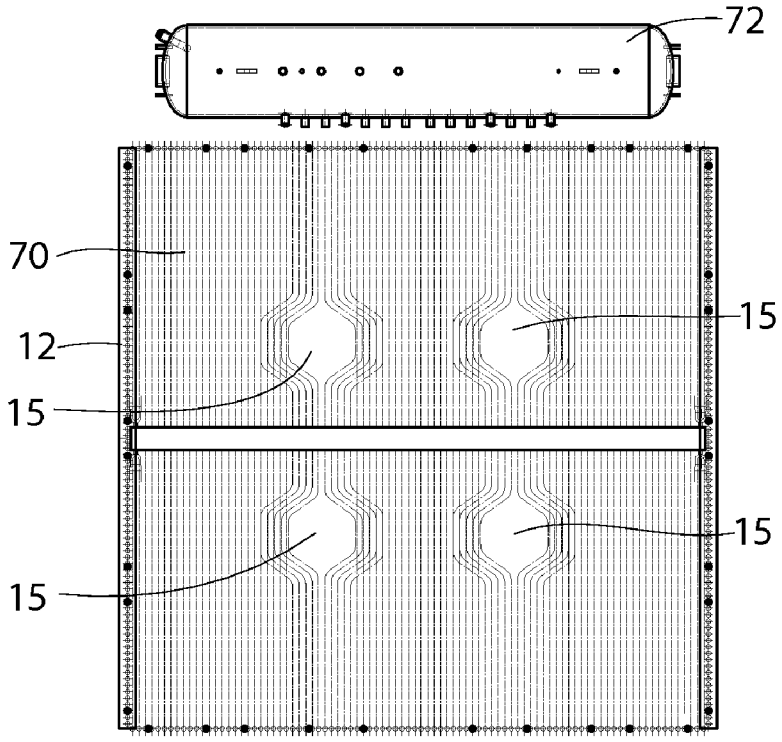
FIG. 7 illustrates in top plan view the boiler of the processed agriculture residue energy recovery apparatus depicted in FIG. 5.

FIG. 5 illustrates in side elevation view the boiler 12 of the processed agriculture residue energy recovery apparatus 10 depicted in FIG. 1. FIG. 6 illustrates in front elevation view the boiler 12 of the processed agriculture residue energy recovery apparatus depicted in FIG. 5. FIG. 7 illustrates in top plan view the boiler 12 of the processed agriculture residue energy recovery apparatus 10 illustrating the water tubes on the top of the boiler bent to define openings 15 for the burners 14.

A reagent like Trona or sodium bicarbonate may be introduced into the flue gas. The reagent insert preferably before the induced draft fan 81 to control or reduce geacous emissions such as hydrogen chloride, hydrogen floride, sulfur dioxide, and other emission gases.

In one embodiment, the present invention relates to a method for extracting energy from PAR, such as DDG or rapeseed cake, by introducing the fiber into the vertically elongated combustion chamber of the boiler 12 having i) at least one suspension burner at the top of the combustion chamber which is capable of projecting a flame down the axis of the combustion chamber, ii) a heat transfer apparatus having at least a portion of a heat collection surface located radially from the flame and below the burner, and iii) an exhaust opening located below the flame and below at least a portion of the heat collection surface; combusting the fuel to yield a mixture containing hot flue gas and semimolten ash above the exhaust opening; transferring heat from the hot flue gas to at least a portion of the heat collection surface substantially by radiation prior to any substantial contact of ash to a surface of the combustion chamber, to yield a mixture containing warm flue gas and non-molten ash; and cooling the warm flue gas with cooling gas, to yield a mixture containing cool flue gas and non-molten ash.

The operation of the PAR energy recovery system 10 is discussed below with reference to FIGS. 1, 2, and 3 with respect to DDG as a processed agriculture residue biomass fuel. The DDG is conveyed, for example, pneumatically, or by means of other conventional fuel feeding assembly, from the supply 16 into the burner 14. The DDG fuel passes through the stone separator and plate magnet 24 to remove noncombustibles and metal and then into the grinder 26. The grinder 26 produces a preferred particle size distribution. The cyclone separator 30 removes dust from the fuel after grinding. The dust collects in the filter 36. The fuel is deposited in the metering bin 38. The venturi fuel feed device 40 mixes air from the primary air source 44 to carry the fuel to the burners 14. The burner 14 receives the fuel/air mixture and directs the mixture into the flame containment portion or upper portion of the boiler 12.

The flame is ignited conventionally, such as with a natural gas or distillate oil ignition device. It is believed however the DDG fuel can maintain a flame without the pilot. It is believed that a fuel with approximately 10% by weight of 100 micron size or less can self-sustain combustion without use of a pilot flame. The burner 14 projects the flame downwardly along a longitudinal axis of the flame containment portion. Secondary air is directed through the inlet 56 into the wind box of the burner 14 for shaping the flame. The air travels through tiertiary air nozzles 64, such as from a header, blending with a supply of air from the air heater 79, and stages the flame within the flame containment portion of the boiler 12.

The combusting DDG fuel within the flame forms hot flue gas and entrained molten ash. The heat is given up or transferred substantially by radiation to the heat collection surfaces of the water tubes 70 that form the walls of the boiler 12. The tubes transfer the heat to the water in the tubes. The heated water rises upwardly and steam flows into the steam drum 72 where the steam is separated and flows to the superheater 76 and/or to other processes requiring the steam.

The hot flue gas is at a combustion temperature about the temperature of the flame. This temperature may differ depending on the PAR being combusted, but generally for DDG is in a range of between about 2900° F. to about 3000° F. As the heat from the hot flue gas transfers to the heat collection surface substantially by radiation, the temperature in the downstream hot flue gas becomes lower. The molten ash begins forming solid non-molten ash particles. A significant portion of the transfer of heat occurs prior to any substantial contact of molten ash to the heat collection surfaces. During the combustion and heat transfer in the boiler 12, a portion of the ash is molten and a portion is non-molten. The molten ash will range during the processing from partially molten to substantially non-molten, as the combusting fuel travels further from the burner 14. The heat transfer yields a mixture of warm flue gas and non-molten ash, as the molten ash becomes non-molten ash. The warm flue gas is at a second temperature within a range from about a molten ash temperature to about an ash fusion temperature. The range of second temperatures is lower than the combustion temperature. Typically in the illustrated embodiment, the warm flue gas is at a temperature in range from about 1250° F. to about 1750° F.

The mixture of the warm flue gas and non-molten ash continues downward movement, and heat continues to transfer to the heat collection surfaces. The temperature modulator meters the cooling gas from the supply of the cooling gas into the combustion chamber in a lower portion of the boiler vertically spaced from the exhaust opening 74. In the illustrated embodiment, the temperature modulator injects the cooling gas (flue gas recirculation or FGR) through the inlet 59 into the combustion chamber. This cools the warm flue gas and yields a mixture containing cool flue gas and non-molten ash. The cool flue gas is at a fourth temperature of about 1250° F. The fourth temperature is lower than the second temperature. The fourth temperature is in a range from about a minimum temperature suitable for downstream heat exchange process requirements and a maximum temperature that is less than about a lowest melting temperature of any ash constituent. This temperature range provides that at least a substantial majority of the ash is non-molten with at most a substantially minority (less than about 10%) of the ash being molten or semi-molten, to reduce downstream fouling.

In one embodiment, the cool flue gas of the fourth temperature passes through the screen 110 which reduces the fourth temperature to a fifth temperature. The fifth temperature does not exceed about 1100° F. The reason for controlling the flue gas temperature at the flue gas exit to about 1100° F. is (1) to sublimate highly corrosive KCL gas to a solid and (2) to minimize the fouling of downstream heat exchange surfaces. It is to be appreciated that embodiments of boilers operating at higher pressures gainfully use the cooling screen 110 while boilers with saturated steam at lower pressures and not employing the superheater can be configured without the cooling screen.

The cool flue gas changes directional flow from vertical to horizontal and exits from the combustion chamber through the exhaust opening 74. The fan 81 induces the flue gas through the screen 110, the superheater 76, the economizer 78, the air heater 79 and the mechanical dust collector 92. The ash (fly ash) is carried into the electrostatic precipitator 80 for collection. Downstream processes, such as for example, selective catalytic reduction (SCR) for scrubbing NOx, assemblies for extraction of particulates and ash, and for use of residual heat, further treat the exhaust before flowing to the stack 86.

Figure 4:
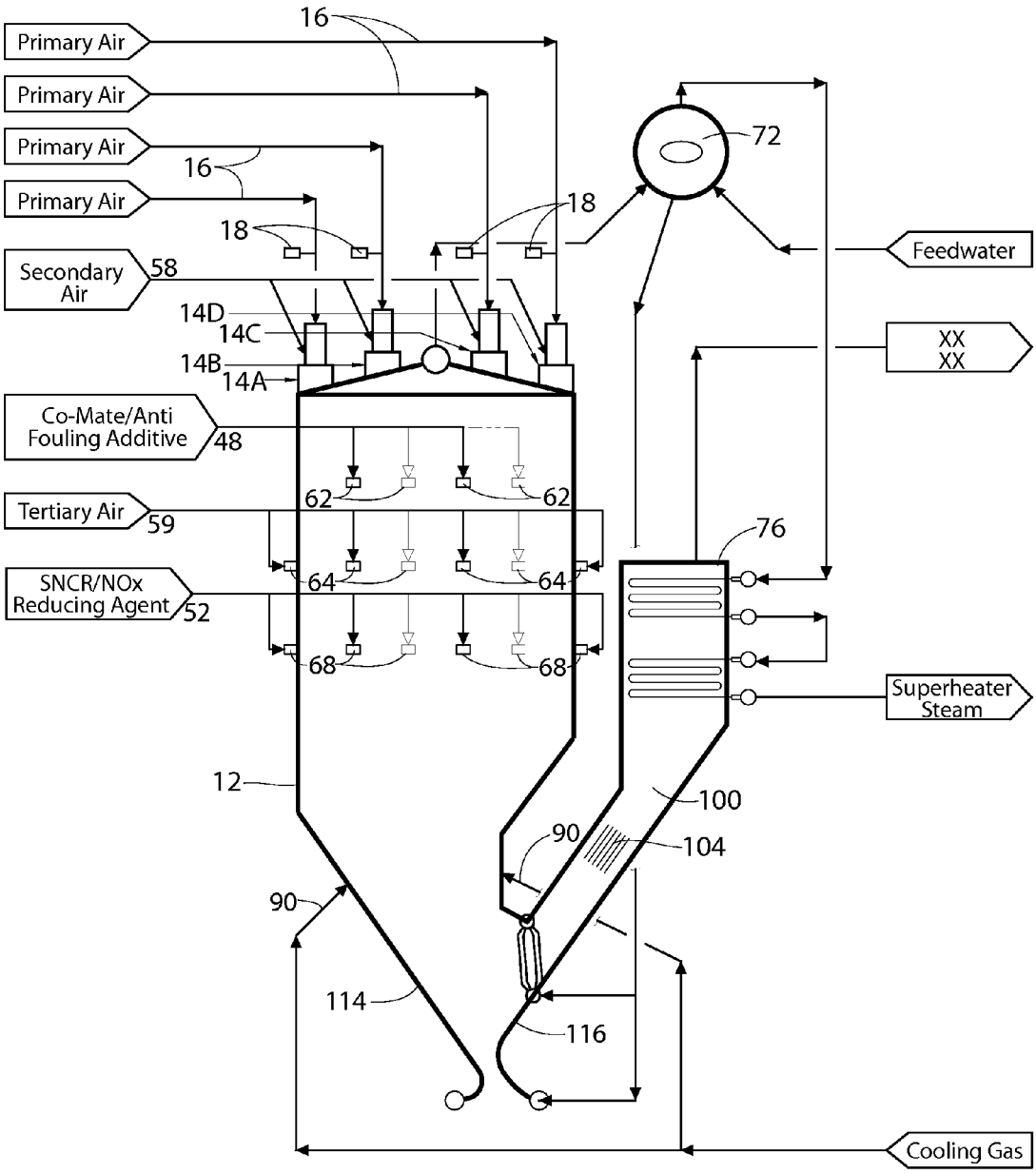
FIG. 4 illustrates a side schematic view of the boiler in the processed agriculture residue energy recovery apparatus having an upwardly angled connection chamber extending from the flue gas exit of the boiler.

FIG. 4 illustrates a side schematic view of the boiler 12 having the upwardly angled superheater connection chamber 100 extending from a lower portion of a hopper 73 in the boiler 12 to the superheater 76. The walls of the chamber 100 are of membrane wall construction using parallel, closely spaced water tubes 104. The ends of the water tubes 104 connect to an inlet vertical header 106 that connects to the water tubes of the membrane wall of the boiler 12 to the steam drum 72, and to an outlet vertical header 108 that connects to the water tubes of the superheater 76. A screen 110 formed of spaced-apart water tubes is positioned in the flue gas inlet of the chamber 100. The upper end of the chamber 100 necks down with a minimum 10 degree slope in order to control the velocity of the flue gas through the superheater 76. The connection chamber 100 is disposed steeply angled at an oblique angle relative to vertical in an upward direction between the boiler gas flue exit and the superheater. The angled slope provides a surface that is less likely for ash to stick, and the angled surfaces out of vertical provide for increased heat absorption.

A lower end of the hopper 73 defines an ash outlet port 112. The port 112 is disposed off-center relative to the boiler 12, for example, as illustrated, approximately two-thirds of the cross-section width of the boiler measured from a point opposing the superheater connection chamber 100. The hopper 73 is defined by a first sloping wall 114 and an opposing stub wall 116. The walls slope downwardly at an angle sufficient for ash particulates to flow to the ash outlet port 112. Conventional sootblowers and steam jets (not illustrated) move the ash. The stub wall 116 forms a narrowing neck in the hopper bottom of the boiler. The narrowing neck contributes to turbulent flow of gases from the boiler into connection chamber 100 for flow to the superheater.

In operation of the boiler 12 with the connection chamber 100, the downward flowing flue gas transfers heat to the water tube side walls as discussed above. The cooling of the flue gas causes the molten and partially molten constituents of the ash to solidify and become agglomerated together. As the ash cools, it solidifies and becomes less sticky which reduces fouling. The turbulent flow in the necking portion contributes to intermixing of the cooling gas and the flue gas prior to entry into the connection chamber—100. The turbulent flow also contributes to the fallout of the ash on to the sloping walls 114 and 116 and passage to the outlet port 112. An ash handling bin (not illustrated) receives the ash from the port 112. Suitable ash handling equipment, for example, a drag chain conveyor (not illustrated) moves the ash from the bin to removal equipment for other use or disposal of the ash.

The sloping walls 114, 116 are sized and disposed at angles sufficient to provide a suitable surface area with effective heat absorption rates. The necked down hopper 73 promotes mixing of the flue gas and the injected cooling gas within the effective heat transfer surfaces of the hopper 73 and the connection chamber 100. The hopper 73 provides a common hopper bottom for receiving ash from the boiler 12 and from the superheater, which ash moves downward on the angled surfaces. The abrupt change of direction for the flue gas from downward in the boiler to a sharply angled upward flow in the connection chamber 100 and into the superheater, promotes ash fallout.

In the present invention, PAR is the fuel burned in the combustion chamber and the oxidant can be oxygen, generally provided in the form of air, an oxygen/nitrogen mixture, or purified oxygen.

Typically, PAR contains some amount of nitrogen. Combustion of nitrogen-containing materials, using air or oxygen as the oxidant, will generate nitrogen oxides (NOx), by reaction between nitrogen liberated from the material and oxygen. In addition, NOx can be generated by high-temperature reaction between nitrogen and oxygen both present in combustion air.

To bring about relatively low NOx production, in one embodiment, the flame temperature can be approximately 3000° F. but the gas cools quickly. Though some NOx is expected to form at these temperatures, it is generally less than the amount expected to form at this or higher temperatures over a longer period of time.

In a more significant embodiment for PAR, combustion is staged with substoichiometric levels of the oxidant (relative to the fuel) fed to the combustion chamber, leading to reduced formation of NOx and increased formation of $N_2$.

Other materials or additives can be added to the boiler during combustion. In one embodiment, the method further comprises adding a reducing agent such as urea or ammonia into the boiler 12 during combusting. The combustion additive can be added in the appropriate temperature regime to maximize NOx reduction. A combustion additive is any material that enhances one or more properties of one or more combustion products.

In a further embodiment, another combustion additive is a material that modifies the properties of the ash, such as its melting point or its tendency to adhere, that can minimize or reduce slagging. There are several materials marketed under various trademarks which could be utilized. An example of such is CO-MATE® material available from Atlantic Combustion Technologies Inc., Amherst, NS. The fed rate of the additive varies with amount of fuel fed into the boiler.

In another embodiment, the method further comprises adding a NOx reducing agent into the flame during combusting. The NOx reducing agent can be any simple reducing compound, and in one embodiment the NOx reducing agent is selected from the group consisting of urea and ammonia. In one embodiment, adding the NOx reducing agent is performed when the furnace is at a temperature from about 1550° F. to about 1750° F. By doing so, NOx quantities in the warm flue gas can be reduced and NOx emissions lowered. This process is called selective non-catalytic reduction (SNCR).

Although NOx emissions may be lowered by one or more of the techniques described above, some NOx may still be present in the flue gas and can be treated by a NOx abatement system (e.g., SCR).

Other steps can be performed, if desired on the exhaust gas. Ash recovery can be performed using a mechanical dust collector, an electrostatic precipitator, or a wet scrubber, among other techniques and apparatus. The non-molten ash can be discarded or sold for other uses, for example, to minimize disposal costs and maximize value, the non-molten ash can be reused as a fertilizer, a land filling material, or a component of a phosphatic cement, among other uses.

Returning to NOx abatement, in one embodiment, NOx in the flue gas can be quantified at the point of emission to the atmosphere by techniques known in the art. This may be useful in complying with emissions regulations in various jurisdictions. In addition, quantifying NOx in the flue gas can provide information, either to the operator or a control device, to enable adjustment of the combustion temperature to reduce the quantity of NOx produced and subsequent NOx levels in the flue gas after heat transfer and cooling being routed to the flue stack or other further processing.

The following examples are included to demonstrate embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

As will be known to a person skilled in the art, the analyses included in the following examples may vary depending on the conditions in the soil, air and water at the time the crops or vegetation were grown, as well as the moisture content of the processed agriculture residue (PAR) fuel at the time the PAR fuel is used as an energy source.

EXAMPLES

Example 1

Dried distiller grains (DDG) are sieved for use as a combustion fuel in a suspension burner. Table 1 details Me sieve analysis. The sieved DDG is burned in a suspension burner and the heat is recovered. The exhaust gases are analysed and burn conditions are achieved which allows BACT (Best Available Control Technology) abatement methodologies to be used successfully on this material as reported in Table 2.

TABLE 1

| Mesh Size | | Direct | Direct | Cumulative Weight % | |
|---|---|---|---|---|---|
| Pass - Retain* | | Weight (g) | Weight % | Retained | Passed |
| | 7 | 29.5 | 7.40 | 7.40 | 92.60 |
| 7 | 12 | 75.0 | 18.83 | 26.23 | 73.77 |
| 12 | 14 | 34.9 | 8.76 | 34.99 | 65.01 |
| 14 | 20 | 120.7 | 30.30 | 65.29 | 34.71 |
| 20 | 28 | 54.9 | 13.78 | 79.07 | 20.93 |
| 28 | 35 | 30.1 | 7.56 | 86.62 | 13.38 |
| 35 | 48 | 16.7 | 4.19 | 90.81 | 9.19 |
| 48 | 65 | 12.9 | 3.24 | 94.05 | 5.95 |
| 65 | 100 | 9.2 | 2.31 | 96.36 | 3.64 |
| 100 | 150 | 5.7 | 1.43 | 97.79 | 2.21 |
| 150 | 200 | 6.8 | 1.71 | 99.50 | 0.50 |
| 200 | PAN | 2.0 | 0.50 | 100.00 | 0.00 |
| | Total | 398.4 | 100.00 | | |

*Taylor Sieve Sizes

TABLE 2

| | Reporting Basis | | |
|---|---|---|---|
| | As Rec'd | Dry | Air Dry |
| Proximate (%) | | | |
| Moisture | 10.24 | 0.00 | 4.23 |
| Ash | 17.14 | 19.10 | 18.29 |
| Volatile | 62.75 | 69.91 | 66.95 |
| Fixed | 9.87 | 10.99 | 10.53 |
| Total | 100.00 | 100.00 | 100.00 |
| Sulfur | 0.60 | 0.67 | 0.64 |
| Btu/lb (HHV) | 6876 | 7661 | 7337 |
| MMF Btu/lb | 8436 | 9654 | |
| MAF Btu/lb | | 9469 | |
| Air dry Loss (%) | 6.28 | | |
| Ultimate (%) | | | |
| Moisture | 10.24 | 0.00 | 4.23 |
| Carbon | 41.38 | 46.10 | 44.15 |
| Hydrogen | 5.33 | 5.94 | 5.69 |

TABLE 2-continued

| | | | |
|---|---|---|---|
| Nitrogen | 3.21 | 3.58 | 3.43 |
| Sulfur | 0.60 | 0.67 | 0.64 |
| Ash | 17.14 | 19.10 | 18.29 |
| Oxygen* | 22.10 | 24.61 | 23.57 |
| Total | 100.00 | 100.00 | 100.00 |

Lb. Alkali/MM Btu = 9.13
Lb. Ash/MM Btu = 24.93
Lb. SO2/MM Btu = 1.74
*Oxygen by Difference.

Elemental Analysis of Ash (%)

| | |
|---|---|
| $SiO_2$ | 4.29 |
| $Al_2O_3$ | 0.67 |
| $TiO_2$ | <0.01 |
| $Fe_2O_3$ | 0.73 |
| CaO | 12.40 |
| MgO | 2.96 |
| $Na_2O$ | 31.80 |
| $K_2O$ | 4.83 |
| $P_2O_5$ | 5.98 |
| $SO_3$ | 2.69 |
| Cl | 35.80 |
| $CO_2$ | 5.76 |
| Total | 107.91 |

| | Ash Fusion Temperatures (Deg F.) | |
|---|---|---|
| | Oxidizing Atmosphere | Reducing Atmosphere |
| Initial | 2232 | 2394 |
| Softening | 2250 | 2414 |
| Hemispherical | 2260 | 2420 |
| Fluid | 2277 | 2439 |

Note:
The ash is calcined @ 1110° F. (600° C.) prior to analysis

Example 2

Pressings from rapeseed are sieved for use as a combustion fuel in a suspension burner. Table 3 details the sieve analysis. The sieved rapeseed pressings are burned in a suspension burner and the heat is recovered. The exhaust gases are analysed and burn conditions are achieved which allows BACT (Best Available Control Technology) abatement methodologies to be used successfully on this material as reported in Table 4.

TABLE 3

| Mesh Size | | Direct | Direct | Cumulative Weight % | |
|---|---|---|---|---|---|
| Pass - Retain* | | Weight (g) | Weight % | Retained | Passed |
| | 0.25" | 388.7 | 95.60 | 95.60 | 4.40 |
| 0.25" | 4 | 3.5 | 0.86 | 96.46 | 3.54 |
| 4 | 6 | 0.6 | 0.15 | 96.61 | 3.39 |
| 6 | 8 | 0.4 | 0.10 | 96.70 | 3.30 |
| 8 | 10 | 0.5 | 0.12 | 96.83 | 3.17 |
| 10 | 14 | 0.8 | 0.20 | 97.02 | 2.98 |
| 14 | 20 | 1.0 | 0.25 | 97.27 | 2.73 |
| 20 | 28 | 0.9 | 0.22 | 97.49 | 2.51 |
| 28 | 35 | 1.1 | 0.27 | 97.76 | 2.24 |
| 35 | 48 | 2.8 | 0.69 | 98.45 | 1.55 |
| 48 | 65 | 2.0 | 0.49 | 98.94 | 1.06 |
| 65 | 100 | 2.4 | 0.59 | 99.53 | 0.47 |
| 100 | 150 | 1.3 | 0.32 | 99.85 | 0.15 |
| 150 | 200 | 0.5 | 0.12 | 99.98 | 0.02 |
| 200 | PAN | 0.1 | 0.02 | 100.00 | 0.00 |
| | Total | 406.64 | 100.00 | | |

*Taylor Sieve Sizes

TABLE 4

| | Reporting Basis | | |
|---|---|---|---|
| | As Rec'd | Dry | Air Dry |
| Proximate (%) | | | |
| Moisture | 8.18 | 0.00 | 8.18 |
| Ash | 5.95 | 6.48 | 5.95 |
| Volatile | 70.70 | 77.00 | 70.70 |
| Fixed C | 15.17 | 16.52 | 15.17 |
| Total | 100.00 | 100.00 | 100.00 |
| Sulfur | 0.58 | 0.63 | 0.58 |
| Btu/lb (HHV) | 8883 | 9675 | 8883 |
| MMF Btu/lb | 9495 | 10408 | |
| MAF Btu/lb | | 10345 | |
| Ultimate (%) | | | |
| Moisture | 8.18 | 0.00 | 8.18 |
| Carbon | 53.74 | 58.53 | 53.74 |
| Hydrogen | 5.84 | 6.37 | 5.84 |
| Nitrogen | 5.11 | 5.57 | 5.11 |
| Sulfur | 0.58 | 0.63 | 0.58 |
| Ash | 5.95 | 6.48 | 5.95 |
| Oxygen* | 20.60 | 22.42 | 20.60 |
| Total | 100.00 | 100.00 | 100.00 |

Lb. Alkali/MM Btu = 1.67
Lb. Ash/MM Btu = 6.70
Lb. SO2/MM Btu = 1.31
*Oxygen by Difference.

Elemental Analysis of Ash (%)

| | |
|---|---|
| $SiO_2$ | 1.77 |
| $Al_2O_3$ | 0.08 |
| $TiO_2$ | 0.04 |
| $Fe_2O_3$ | 0.27 |
| CaO | 16.70 |
| MgO | 10.60 |
| $Na_2O$ | 0.10 |
| $K_2O$ | 24.80 |
| $P_2O_5$ | 42.69 |
| $SO_3$ | 2.34 |
| Cl | 0.11 |
| $CO_2$ | 0.87 |
| Total | 100.37 |

| | Ash Fusion Temperatures (Deg F.) | |
|---|---|---|
| | Oxidizing Atmosphere | Reducing Atmosphere |
| Initial | 2024 | 2126 |
| Softening | 2038 | 2137 |
| Hemispherical | 2045 | 2147 |
| Fluid | 2049 | 2156 |

Note:
The ash is calcined @ 1110° F. (600° C.) prior to analysis

Example 3

Dried distiller grains (DDG) are sieved for use as a combustion fuel in a suspension burner. Table 5 details the sieve analysis. The sieved DDG is burned in a suspension burner and the heat is recovered. The exhaust gases are analysed and burn conditions are achieved which allows BACT (Best Available Control Technology) abatement methodologies to be used successfully on this material as reported in Table 6.

TABLE 5

| Mesh Size | | Direct | Direct | Cumulative Weight % | |
|---|---|---|---|---|---|
| Pass - Retain* | | Weight (g) | Weight % | Retained | Passed |
| | 35 | 27.0 | 27.14 | 27.14 | 72.86 |
| 35 | 48 | 17.0 | 17.09 | 44.22 | 55.78 |
| 48 | 65 | 16.5 | 16.58 | 60.80 | 39.20 |
| 65 | 100 | 14.5 | 14.57 | 75.38 | 24.62 |
| 100 | 150 | 22.0 | 22.11 | 97.49 | 2.51 |
| 150 | 200 | 2.5 | 2.51 | 100.00 | 0.00 |
| 200 | PAN | 0.0 | 0.00 | 100.00 | 0.00 |
| | Total | 99.5 | 100.00 | | |

*Taylor Sieve Sizes

TABLE 6

| | Reporting Basis | | |
|---|---|---|---|
| | As Rec'd | Dry | Air Dry |
| Proximate (%) | | | |
| Moisture | 15.20 | 0.00 | 4.17 |
| Ash | 4.83 | 5.70 | 5.46 |
| Volatile | 68.16 | 80.38 | 77.03 |
| Fixed | 11.81 | 13.92 | 13.34 |
| Total | 100.00 | 100.00 | 100.00 |
| Sulfur | 0.22 | 0.26 | 0.25 |
| Btu/lb (HHV) | 7636 | 9005 | 8629 |
| MMF Btu/lb | 8055 | 9596 | |
| MAF Btu/lb | | 9549 | |
| Air dry Loss (%) | 11.51 | | |
| Ultimate (%) | | | |
| Moisture | 15.20 | 0.00 | 4.17 |
| Carbon | 42.60 | 50.23 | 48.14 |
| Hydrogen | 5.35 | 6.31 | 6.04 |
| Chlorine | 0.157 | 0.185 | |
| Fluorine | 0.002 | 0.002 | |
| Nitrogen | 3.11 | 3.67 | 3.52 |
| Sulfur | 0.22 | 0.26 | 0.25 |
| Ash | 4.83 | 5.70 | 5.46 |
| Oxygen* | 28.53 | 33.64 | 32.42 |
| Total | 100.00 | 100.00 | 100.00 |

Lb. Alkali/MM Btu = 2.52
Lb. Ash/MM Btu = 6.33
Lb. SO2/MM Btu = 0.58
*Oxygen by Difference.

Elemental Analysis of Ash (%)

| | |
|---|---|
| $SiO_2$ | 6.33 |
| $Al_2O_3$ | 1.20 |
| $TiO_2$ | 0.18 |
| $Fe_2O_3$ | 0.88 |
| CaO | 1.45 |
| MgO | 11.10 |
| $Na_2O$ | 14.60 |
| $K_2O$ | 25.20 |
| $P_2O_5$ | 37.24 |
| $SO_3$ | 0.28 |
| Cl | 2.53 |
| $CO_2$ | 0.15 |
| Total | 101.14 |

| | Ash Fusion Temperatures (Deg F.) | |
|---|---|---|
| | Oxidizing Atmosphere | Reducing Atmosphere |
| Initial | 1706 | 1719 |
| Softening | 1710 | 1739 |

TABLE 6-continued

| | | |
|---|---|---|
| Hemispherical | 1715 | 1742 |
| Fluid | 1731 | 1747 |

Note:

The ash is calcined @ 1110° F. (600° C.) prior to analysis

Example 4

Dried distiller grains (DDG) are sieved for use as a combustion fuel in a suspension burner. Table 7 details the sieve analysis The sieved DDG is burned in a suspension burner and the heat is recovered. The exhaust gases are analysed and burn conditions are achieved which allows BACT (Best Available Control Technology) abatement methodologies to be used successfully on this material as reported in Table 8.

TABLE 7

| Mesh Size | | Direct | Direct | Cumulative Weight % | |
|---|---|---|---|---|---|
| Pass - Retain* | | Weight (g) | Weight % | Retained | Passed |
| | 35 | 44.0 | 45.36 | 45.36 | 54.64 |
| 35 | 48 | 22.0 | 22.68 | 68.04 | 31.96 |
| 48 | 65 | 14.0 | 14.43 | 82.47 | 17.53 |
| 65 | 100 | 10.5 | 10.82 | 93.30 | 6.70 |
| 100 | 150 | 4.5 | 4.64 | 97.94 | 2.06 |
| 150 | 200 | 1.5 | 1.55 | 99.48 | 0.52 |
| 200 | PAN | 0.5 | 0.52 | 100.00 | 0.00 |
| | Total | 97.0 | 100.00 | | |

*Taylor Sieve Sizes

TABLE 8

| | Reporting Basis | | |
|---|---|---|---|
| | As Rec'd | Dry | Air Dry |
| Proximate (%) | | | |
| Moisture | 7.52 | 0.00 | 2.76 |
| Ash | 4.65 | 5.03 | 4.89 |
| Volatile | 75.01 | 81.12 | 78.88 |
| Fixed C | 12.82 | 13.85 | 13.47 |
| Total | 100.00 | 100.00 | 100.00 |
| Sulfur | 0.24 | 0.26 | 0.25 |
| Btu/lb (HHV) | 8391 | 9074 | 8823 |
| MMF Btu/lb | 8834 | 9595 | |
| MAF Btu/lb | | 9554 | |
| Air dry Loss (%) | 4.90 | | |
| Ultimate (%) | | | |
| Moisture | 7.52 | 0.00 | 2.76 |
| Carbon | 47.01 | 50.83 | 49.43 |
| Hydrogen | 5.93 | 6.41 | 6.23 |
| Chlorine | 0.140 | 0.151 | |
| Fluorine | 0.001 | 0.001 | |
| Nitrogen | 3.58 | 3.87 | 3.76 |
| Sulfur | 0.24 | 0.26 | 0.25 |

TABLE 8-continued

| | | | |
|---|---|---|---|
| Ash | 4.65 | 5.03 | 4.89 |
| Oxygen* | 30.93 | 33.45 | 32.68 |
| Total | 100.00 | 100.00 | 100.00 |

Lb. Alkali/MM Btu = 2.31
Lb. Ash/MM Btu = 5.54
Lb. SO2/MM Btu = 0.57
*Oxygen by Difference.

Elemental Analysis of Ash (%)

| | |
|---|---|
| $SiO_2$ | 4.67 |
| $Al_2O_3$ | 0.23 |
| $TiO_2$ | 0.04 |
| $Fe_2O_3$ | 0.67 |
| CaO | 1.13 |
| MgO | 11.70 |
| $Na_2O$ | 15.50 |
| $K_2O$ | 26.20 |
| $P_2O_5$ | 40.27 |
| $SO_3$ | 0.39 |
| Cl | 1.90 |
| $CO_2$ | 0.05 |
| Total | 102.75 |

| | Ash Fusion Temperatures (Deg F.) | |
|---|---|---|
| | Oxidizing Atmosphere | Reducing Atmosphere |
| Initial | 1664 | 1667 |
| Softening | 1745 | 1693 |
| Hemispherical | 1782 | 1724 |
| Fluid | 1796 | 1776 |

Note:

The ash is calcined @ 1110° F. (600° C.) prior to analysis

Example 5

Dried distiller grains (DDG) are sieved for use as a combustion fuel in a suspension burner. Table 9 details the sieve analysis. The sieved DDG is burned in a suspension burner and the heat is recovered. The exhaust gases are analysed and burn conditions are achieved which allows BACT (Best Available Control Technology) abatement methodologies to be used successfully on this material as reported in Table 10.

TABLE 9

| Mesh Size | | Direct | Direct | Cumulative Weight % | |
|---|---|---|---|---|---|
| Pass - Retain* | | Weight (g) | Weight % | Retained | Passed |
| | 35 | 52.0 | 52.79 | 52.79 | 47.21 |
| 35 | 48 | 22.0 | 22.34 | 75.13 | 24.87 |
| 48 | 65 | 13.5 | 13.71 | 88.83 | 11.17 |
| 65 | 100 | 7.0 | 7.11 | 95.94 | 4.06 |
| 100 | 150 | 3.0 | 3.05 | 98.98 | 1.02 |
| 150 | 200 | 1.0 | 1.02 | 100.00 | 0.00 |
| 200 | PAN | 0.0 | 0.00 | 100.00 | 0.00 |
| | Total | 98.5 | 100.00 | | |

*Taylor Sieve Sizes

TABLE 10

| | Reporting Basis | | |
|---|---|---|---|
| | As Rec'd | Dry | Air Dry |
| Proximate (%) | | | |
| Moisture | 7.90 | 0.00 | 3.50 |
| Ash | 4.86 | 5.27 | 5.09 |
| Volatile | 74.19 | 80.55 | 77.73 |
| Fixed | 13.05 | 14.18 | 13.68 |
| Total | 100.00 | 100.00 | 100.00 |
| Sulfur | 0.25 | 0.27 | 0.26 |
| Btu/lb (HHV) | 8266 | 8975 | 8661 |
| MMF Btu/lb | 8723 | 9518 | |
| MAF Btu/lb | | 9475 | |
| Air dry Loss (%) | 4.56 | | |
| Ultimate (%) | | | |
| Moisture | 7.90 | 0.00 | 3.5 |
| Carbon | 46.48 | 50.47 | 48.70 |
| Hydrogen | 5.86 | 6.36 | 6.14 |
| Chlorine | 0.146 | 0.159 | |
| Fluorine | 0.001 | 0.001 | |
| Nitrogen | 3.44 | 3.73 | 3.60 |
| Sulfur | 0.25 | 0.27 | 0.26 |
| Ash | 4.86 | 5.27 | 5.09 |
| Oxygen* | 31.06 | 37.74 | 32.71 |
| Total | 100.00 | 100.00 | 100.00 |

Lb. Alkali/MM Btu = 2.37
Lb. Ash/MM Btu = 5.88
Lb. SO2/MM Btu = 0.60
*Oxygen by Difference.

Elemental Analysis of Ash (%)

| | |
|---|---|
| $SiO_2$ | 3.84 |
| $Al_2O_3$ | 0.29 |
| $TiO_2$ | 0.22 |
| $Fe_2O_3$ | 0.68 |
| CaO | 1.30 |
| MgO | 11.60 |
| $Na_2O$ | 15.20 |
| $K_2O$ | 25.20 |
| $P_2O_5$ | 39.21 |
| $SO_3$ | 0.51 |
| Cl | 2.02 |
| $CO_2$ | 0.04 |
| Total | 100.11 |

| | Ash Fusion Temperatures (Deg F.) | |
|---|---|---|
| | Oxidizing Atmosphere | Reducing Atmosphere |
| Initial | 1707 | 1709 |
| Softening | 1734 | 1739 |
| Hemispherical | 1754 | 1753 |
| Fluid | 1785 | 1781 |

Note:
The ash is calcined @ 1110° F. (600° C.) prior to analysis

Example 6

Dried distiller grains (DDG) are sieved for use as a combustion fuel in a suspension burner. Table 11 details the sieve analysis. The sieved DDG is burned in a suspension burner and the heat is recovered. The exhaust gases are analysed and burn conditions are achieved which allows BACT (Best Available Control Technology) abatement methodologies to be used successfully on this material as reported in Table 12.

TABLE 11

| Mesh Size | | Direct | Direct | Cumulative Weight % | |
|---|---|---|---|---|---|
| Pass - Retain* | | Weight (g) | Weight % | Retained | Passed |
| | 35 | 52.0 | 52.53 | 52.53 | 47.47 |
| 35 | 48 | 22.5 | 22.73 | 75.25 | 24.75 |
| 48 | 65 | 13.0 | 13.13 | 88.38 | 11.62 |
| 65 | 100 | 7.0 | 7.07 | 95.45 | 4.55 |
| 100 | 150 | 3.0 | 3.03 | 98.48 | 1.52 |
| 150 | 200 | 1.5 | 1.52 | 100.00 | 0.00 |
| 200 | PAN | 0.0 | 0.00 | 100.00 | 0.00 |
| | Total | 99.0 | 100.00 | | |

*Taylor Sieve Sizes

TABLE 12

| | Reporting Basis | | |
|---|---|---|---|
| | As Rec'd | Dry | Air Dry |
| Proximate (%) | | | |
| Moisture | 8.51 | 0.00 | 1.72 |
| Ash | 4.65 | 5.08 | 4.99 |
| Volatile | 74.21 | 81.12 | 79.72 |
| Fixed C | 12.63 | 13.80 | 13.57 |
| Total | 100.00 | 100.00 | 100.00 |
| Sulfur | 0.23 | 0.25 | 0.25 |
| Btu/lb (HHV) | 8346 | 9122 | 8965 |
| MMF Btu/lb | 8786 | 9652 | |
| MAF Btu/lb | | 9610 | |
| Air dry Loss (%) | 6.91 | | |
| Ultimate (%) | | | |
| Moisture | 8.51 | 0.00 | 1.72 |
| Carbon | 46.58 | 50.92 | 50.04 |
| Hydrogen | 5.87 | 6.42 | 6.31 |
| Chlorine | 0.140 | 0.153 | |
| Fluorine | 0.001 | 0.001 | |
| Nitrogen | 3.54 | 3.87 | 3.80 |
| Sulfur | 0.23 | 0.25 | 0.25 |
| Ash | 4.65 | 5.08 | 4.99 |
| Oxygen* | 30.48 | 33.31 | 32.89 |
| Total | 100.00 | 100.00 | 100.00 |

Lb. Alkali/MM Btu = 2.28
Lb. Ash/MM Btu = 5.57
Lb. SO2/MM Btu = 0.56
*Oxygen by Difference.

Elemental Analysis of Ash (%)

| | |
|---|---|
| $SiO_2$ | 4.30 |
| $Al_2O_3$ | 0.22 |
| $TiO_2$ | 0.09 |
| $Fe_2O_3$ | 0.71 |
| CaO | 1.21 |
| MgO | 11.60 |
| $Na_2O$ | 15.10 |
| $K_2O$ | 25.90 |
| $P_2O_5$ | 39.57 |
| $SO_3$ | 0.37 |
| Cl | 2.08 |
| $CO_2$ | 0.07 |
| Total | 101.22 |

| | Ash Fusion Temperatures (Deg F.) | |
|---|---|---|
| | Oxidizing Atmosphere | Reducing Atmosphere |
| Initial | 1661 | 1665 |
| Softening | 1717 | 1693 |

TABLE 12-continued

| | | |
|---|---|---|
| Hemispherical | 1743 | 1720 |
| Fluid | 1783 | 1750 |

Note:
The ash is calcined @ 1110° F. (600° C.) prior to analysis.

The apparatus and methods disclosed herein can be made and executed without undue experimentation in light of the present disclosure. While the apparatus of this invention have been described in terms of preferred embodiments, it will be apparent to those of skill in the art that variations may be applied to the apparatus and in the method steps or in the sequence of steps thereof described herein without departing from the concept, spirit and scope of the invention. All such similar substitutes and modifications apparent to those skilled in the art are deemed to be within the spirit, scope and concept of the invention as defined by the appended claims.

What is claimed is:

1. An apparatus that extracts energy from processed agriculture residue (PAR) fuel, comprising:

a vertically elongated combustion chamber having a top end, a flame containment portion, and a lower end portion;

a supply of a processed agriculture residue (PAR) fuel for combusting in the combustion chamber, the PAR fuel having a moisture content of about 12% by weight or less;

at least one suspension burner mounted at the top end of the combustion chamber and receiving a mixture of combustion air and PAR fuel, the burner configured for projecting a flame down a longitudinal axis of the flame containment portion of the combustion chamber;

a wall of the combustion chamber defining a heat transfer apparatus having at least a portion of a heat collection surface located radially from the flame; and an exhaust opening in a hopper wall of the combustion chamber vertically spaced from a distal end of the flame containment portion and vertically spaced lower of a substantial majority of the heat collection surface, whereby the PAR fuel combusted within the combustion chamber yields a mixture containing hot flue gas of a first temperature and entrained molten ash above the exhaust opening, the first temperature at about a combustion temperature of the flame, with heat from the hot flue gas transferring to the heat collection surface substantially by radiation to yield a mixture of warm flue gas of a second temperature and non-molten ash, the second temperature in a range from about an ash fusion temperature to about an ash molten temperature, the range lower than the combustion temperature;

a temperature modulator that receives cooling gas from a supply of the cooling air at a third temperature, which modulator meters the cooling air into the combustion chamber proximate to the exhaust opening, to cool the warm flue gas and yield a mixture containing cool flue gas at a fourth temperature and non-molten ash, the fourth temperature less than the ash fusion temperature, the fourth temperature lower than the second temperature, which cool flue gas exits from the combustion chamber through the exhaust opening

2. The apparatus as recited in claim 1, wherein the flame containment portion is sized for combusting the PAR fuel prior to any substantial contact of fly-ash to a surface of the combustion chamber.

3. The apparatus as recited in claim 1, wherein the combustion temperature of the PAR fuel within the flame is from about 2900° F. to about 3000° F.

4. The apparatus as recited in claim 1, wherein the second temperature has a range of about 1250° F. to about 1750° F.

5. The apparatus as recited in claim 1 wherein the fourth temperature is less than about 1250° F.

6. The apparatus as recited in claim 1, wherein the third temperature is about 375° F. or less.

7. The apparatus as recited in claim 1, further comprising a screen assembly located near the flue gas exit which is a heat transfer apparatus to further reduce the temperature of the cool flue gas, which cool flue gas passes through the screen that further reduces the gas temperature to a fifth temperature, the fifth temperature being lower than the fourth temperature.

8. The apparatus as recited in claim 7, wherein the fifth temperature does not exceed 1100° F.

9. The apparatus as recited in claim 1, further comprising a sensor to monitor the quantity of NOx in the warm flue gas.

10. The apparatus as recited in claim 1, further comprising an inlet to the combustion chamber that receives a combustion additive selectively added to modify the melting properties of the ash to reduce slagging.

11. The apparatus as recited in claim 1, further comprising an inlet to the combustion chamber for introducing a reducing agent to reduce the quantity of NOx in the warm flue gas.

12. The apparatus as recited in claim 11, wherein the reducing agent comprises a simple nitrogenous compound.

13. The apparatus as recited in claim 11, wherein the reducing agent is selected from the group consisting of urea and ammonia.

14. The apparatus as recited in claim 1, further comprising a connecting chamber between the flue gas exit from the hopper and a superheater, said connecting chamber having heat collection surfaces and disposed at an oblique upward angle relative to the combustion chamber.

15. The apparatus as recited in claim 1, further comprising a reducer that receives the cool flue gas from the exhaust opening and removes a portion of the NOx therefrom.

16. The apparatus as recited in claim 15 wherein the reducer is a selective catalytic reducer.

17. The apparatus as recited in claim 1, wherein the supply of the cooling gas is recirculated cool flue gas.

18. A method for extracting energy from a processed agriculture residue (PAR) fuel, comprising the steps of:

(a) introducing a PAR fuel through a burner attached to a top end of a vertically elongated combustion chamber, the burner configured for projecting a flame down a longitudinal axis of a flame containment portion of the combustion chamber;

(b) combusting the PAR fuel within a flame in the flame containment portion of the combustion chamber to yield a mixture containing hot flue gas and entrained molten ash;

(e) transferring heat from the hot flue gas to a heat transfer apparatus having at least a portion of a heat collection surface located radially from the flame in the flame containment portion of the combustion chamber substantially by radiation prior to any substantial contact of molten ash to a surface of the combustion chamber to yield a mixture of warm flue gas and non-molten ash, the warm flue gas at a second temperature in a range from about an ash fusion temperature to about a molten ash temperature, the second temperature lower than the combustion temperature;

(d) inserting into the combustion chamber a cooling gas near an exhaust opening in a hopper wall of the combustion chamber vertically spaced from a distal end of the flame containment portion and vertically spaced lower then a substantial majority of the heat collection surface, the cooling gas at a third temperature to cool the warm flue gas and yield a mixture containing cool flue gas and non-molten ash, the cool flue gas at a fourth temperature in a range from ambient temperature to about the ash fusion temperature, the fourth temperature lower than the second temperature and the third temperature lower than the fourth temperature; and (e) removing the cool flue gas from the combustion chamber through the exhaust opening.

19. The method as recited in claim 18, further comprising the step of providing at least a portion of the cool flue gas—to the temperature modulator.

20. The method as recited in claim 18, wherein the combustion temperature of the PAR fuel within the flame is from about 2900° F. to about 3000° F.

21. The method as recited in claim 18 wherein the second temperature has a range of about 1250° F. to about 1750° F.

22. The method as recited in claim 18, wherein the fourth temperature is about 1250° F. or less.

23. The method as recited in claim 18, wherein the third temperature is about 375° F. or less.

24. The method as recited in claim 18, further comprising the step of passing the cool flue gas through a screen assembly located near the flue gas exit to further reduce the temperature of the cool flue gas to a fifth temperature, the fifth temperature lower than the fourth temperature.

25. The method as recited in claim 24, wherein the fifth temperature does not exceed 1100° F.

26. The method as recited in claim 18, further comprising the step of inserting a combustion additive into the burner to reduce slag and ash buildup.

27. The method as recited in claim 18, further comprising inserting a reducing agent from a supply through an inlet into the combustion chamber for reducing the quantity of NOx in the warm flue gas.

28. The method as recited in claim 27, wherein the reducing agent comprises a simple nitrogenous compound.

29. The method as recited in claim 27, wherein the reducing agent is selected from the group consisting of urea and ammonia.

30. The method as recited in claim 18, further comprising the step of reducing a portion of the NOx in the cool flue gas after passing from the exhaust opening.

31. The method as recited in claim 30, wherein the step of reducing comprises passing the cool flue gas through a selective catalytic reducer.

32. The method as recited in claim 18, further comprising the step of collecting non-molten ash in a hopper in a lower portion of the combustion chamber.

33. The method as recited in claim 32, the hopper having an outlet for discharging non-molten ash to a collection device.

* * * * *